US006886310B1

(12) United States Patent
Bois

(10) Patent No.: US 6,886,310 B1
(45) Date of Patent: May 3, 2005

(54) DEVICE AND METHOD FOR MAKING PACKAGING BAGS

(75) Inventor: Henri-Georges Bois, Neuilly sur Seine (FR)

(73) Assignee: Flexico-France, Henonville (FR)

( * ) Notice: Subject to any disclaimer, the term of this patent is extended or adjusted under 35 U.S.C. 154(b) by 50 days.

(21) Appl. No.: 09/786,191

(22) PCT Filed: Jul. 4, 2000

(86) PCT No.: PCT/FR00/01903

§ 371 (c)(1),
(2), (4) Date: May 24, 2001

(87) PCT Pub. No.: WO01/02162

PCT Pub. Date: Jan. 11, 2001

(30) Foreign Application Priority Data

Jul. 5, 1999 (FR) ..... 99 08625

(51) Int. Cl.[7] ..... B65B 61/18; B65B 57/00
(52) U.S. Cl. ..... 53/412; 53/450; 53/51
(58) Field of Search ..... 53/412, 450, 451, 53/498, 133.3, 133.4, 133.5, 57, 65, 66, 51, 75, 548, 550, 551

(56) References Cited

U.S. PATENT DOCUMENTS

| | | | | | |
|---|---|---|---|---|---|
| 3,988,184 | A | * | 10/1976 | Howard | 156/66 |
| 4,722,166 | A | * | 2/1988 | Dieckow | 53/133.4 |
| 4,745,731 | A | * | 5/1988 | Talbott et al. | 53/551 |
| 4,876,842 | A | * | 10/1989 | Ausnit | 53/133.1 |
| 5,401,533 | A | * | 3/1995 | Borland | 427/208.2 |
| 5,930,983 | A | * | 8/1999 | Terminella et al. | 53/133.4 |
| 6,047,521 | A | * | 4/2000 | Terminella et al. | 53/133.4 |
| 6,216,423 | B1 | * | 4/2001 | Thieman | 53/133.4 |

* cited by examiner

*Primary Examiner*—Louis Huynh
(74) *Attorney, Agent, or Firm*—Finnegan, Henderson, Farabow, Garrett & Dunner, L.L.P

(57) ABSTRACT

An apparatus for forming reclosable bags, wherein said bags are formed from a continuously film (12) fitted with at least one closure tape (60), wherein the apparatus comprises a set of heat-sealed jaws (30) provided transversely relative to the travel direction of the film (12), at least one sensor (100) that if the tape (60) is present or not on the film in a predetermined position relative to the heat-sealed jaws, and means suitable to reposition correctly the film in regard of the heat-sealed jaws when the sensor detects a default in the position of the tape, so as to eliminate drift due to the elasticity of the film.

16 Claims, 2 Drawing Sheets

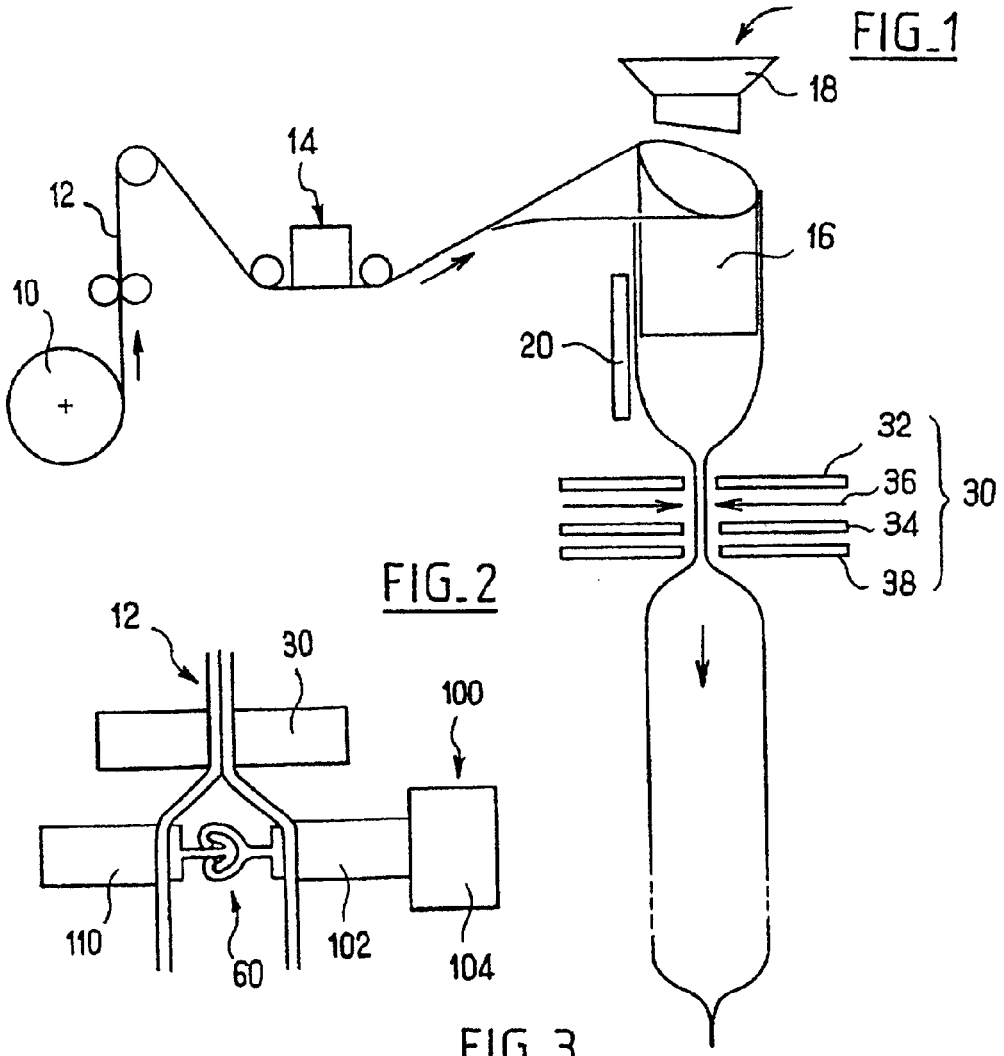
FIG_1
18
14
12
16
10
20
32
36
30
34
38
FIG_2
12
30
100
110
60
102
104
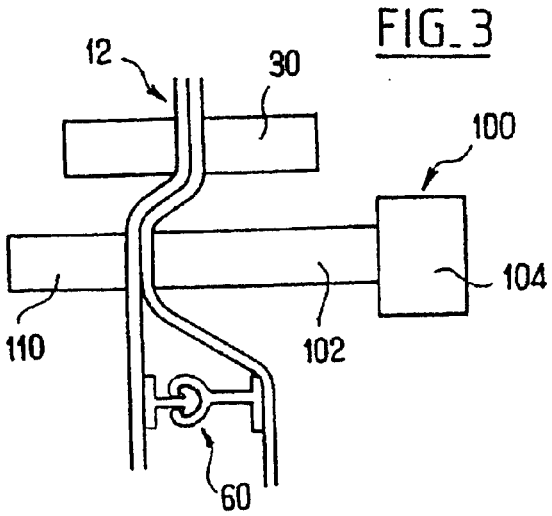
FIG_3
12
30
100
104
110
102
60

DEVICE AND METHOD FOR MAKING PACKAGING BAGS

BACKGROUND OF THE INVENTION

The present invention relates to the field of manufacturing packaging bags.

More precisely, the present invention relates to apparatuses for manufacturing packaging bags from a continuously traveling film fitted with at least one tape having an opening/closing function. More precisely still, the present invention relates preferably to apparatuses for manufacturing bags in which the tape having an opening/closing function extends transversely to the travel direction of the film.

Nevertheless, as described in greater detail below, the present invention is not limited to this specific application. The invention can also be applied to apparatuses in which said tapes having an opening/closing function are disposed parallel to the travel direction of the film or obliquely relative to said direction.

Numerous apparatuses of this kind are known.

The tape having an opening/closing function can take numerous forms.

By way of example, the tape having an opening/closing function can be formed by complementary closure strips, e.g. male/female strips, or strips with complementary hooks, placed on opposite faces of the film.

The tape having an opening/closing function can also be formed by a tear/cut tape or strip, an adhesive tape, which can optionally be a peel-off tape, or indeed a metal tape for closing by being folded, etc.

Such apparatuses for manufacturing packaging bags are known in which travel takes place horizontally or vertically.

In particular, so-called form, fill, and seal (FFS) machines are known which automatically form the bags, fill them, and then close them.

In particular, FFS machines are known that comprise:

means for delivering the film in the plane state;

means for shaping the film into a tubular state on a forming neck;

means for closing the resulting tube longitudinally, generally by heat-sealing;

a funnel which opens out into the tube formed in this way for conveying the product that is to be packaged; and means for fixing the tubular film in a transverse direction, generally again by heat-sealing.

Still more precisely, said means are generally designed to provide almost simultaneously a line of heat-sealing that constitutes, for example, the bottom of a bag that is upstream in the travel direction, a second line of heat-sealing closing the mouth of a bag downstream therefrom, and a line of cut sectioning the tubular film so as to separate the finished downstream bag from the upstream bag that is in preparation.

In particular, machines now exist that have a station designed for fixing the tape having an opening/closing function onto the film upstream from the forming neck, and to do so transversely relative to the travel direction of the film.

Nevertheless, in a variant, the closure tape can be placed longitudinally, i.e. parallel to the travel direction of the film, or indeed obliquely relative to said direction.

Those known machines have already given good service.

Nevertheless, they do not always give complete satisfaction in the sense that it is sometimes difficult to control accurately proper positioning of the tape having an opening/closing function.

This problem is particularly severe with machines that operate continuously with the film travelling at very high speed.

SUMMARY OF THE INVENTION

An object of the present invention is thus to improve conventional apparatuses for manufacturing packaging bags by enabling the positioning of the tape having an opening/closing function to be detected reliably.

In the context of the present invention, this object is achieved by apparatus for forming bags and including at least one sensor suitable for detecting the presence of the tape having an opening/closing function when it is in a predetermined position relative to means for treating the film cyclically in order to form bags, and in particular relative to means provided on the apparatus for closing the bag-constituting film transversely.

According to an advantageous additional characteristic of the present invention, the sensor is constituted by a mechanical feeler.

The present invention also provides a method of making bags.

BRIEF DESCRIPTION OF THE DRAWINGS

Other characteristics, objects, and advantages of the present invention will appear on reading the following detailed description and from the accompanying drawings which are given as non-limiting examples, and in which:

FIG. 1 is a diagrammatic view of apparatus for forming packaging bags in accordance with the present invention;

FIGS. 2 and 3 are views on a larger scale of a sensor in accordance with the present invention, respectively when detecting proper positioning of a tape and when detecting wrong positioning thereof;

DETAILED DESCRIPTION OF THE DRAWINGS

Figure 4:
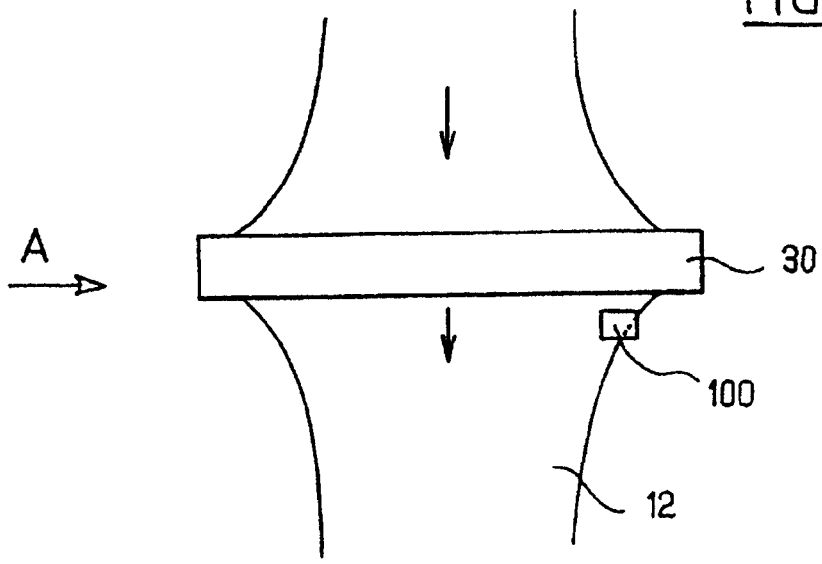
FIG. 4 is a fragmentary side view of the apparatus showing the location of the sensor.
Figure 5:
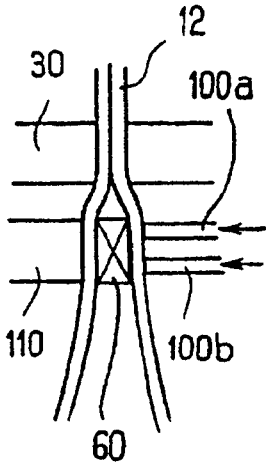
FIGS. 5, 6, 7, and 8 are views similar to FIGS. 2 and 3 for a dual sensor and respectively on the assumption that positioning of the tape in question is detected as being correct, in FIG. 5, and incorrect in FIGS. 6, 7, and 8.
Figure 6:
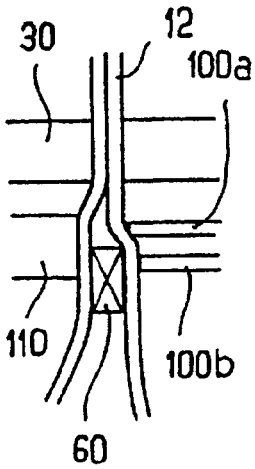
Figure 7:
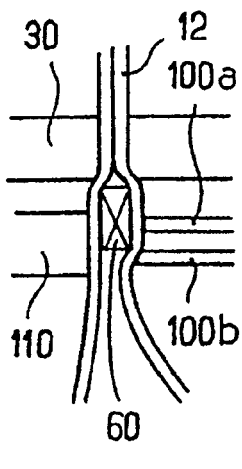
Figure 8:
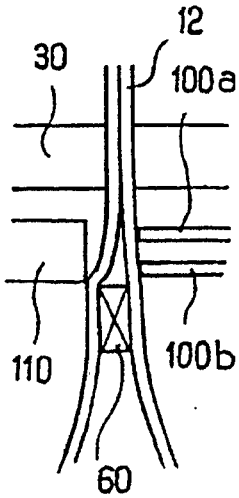

The description below relates essentially to apparatus in which the closing/opening tape is placed transversely to the travel direction of the film. Nevertheless, the invention is not limited to this disposition. The invention also applies to apparatuses in which the closing/opening tape is placed parallel to the travel direction of the film, or obliquely relative thereto.

FIG. 1 shows apparatus for forming packaging bags to which the invention applies particularly, but not exclusively. Specifically this is an FFS type machine with the film travelling vertically.

FIG. 1 shows a roll 10 from which a plane film 12 is unrolled.

The film 12 is guided by various wheels or equivalent means which are not described in detail below insofar as they can be embodied in a wide variety of ways.

In the context of the invention and preferably, the apparatus has a station 14 downstream from the roll 10 for the purpose of placing an opening/closing tape on the film 12 transversely to the travel direction of the film.

The film 12 then reaches a forming neck 16. This is shaped in such a manner that on leaving the forming neck 16, the film 16 is in a tubular state. A filling funnel 18 is disposed above the forming neck 16 and opens out into the tube that it forms. In conventional manner, the filling funnel 18 is used to insert the product which is to be packaged into the bag blanks that are formed by said tubular film.

Means shown diagrammatically in FIG. 1 under reference 20 are designed to close the tubular film longitudinally, e.g. by heat-sealing.

Downstream from this station 20, there is an assembly 30 which is designed to perform the following operations:

- using means 32 to make a transverse line of heat-sealing on an upstream bag blank, to correspond to the bottom of the upstream bag;
- using means 34 to make a transverse line of heat-sealing to finish off a downstream bag, the line of heat-sealing being provided at the mouth thereof;
- using sectioning means 36 interposed between the above-specified means 32 and 34 to section the film so as to separate the completed downstream bag from the upstream bag blank; and
- optionally using means 38 for finishing off the fixing of the tape having an opening/closing function on the wall of the film.

Where appropriate, the tape having an opening/closing function can be fixed in the station 14 to only half of the width of the film, with the tape being fixed to the other half of the width of the film downstream from the forming neck 16 by the above-mentioned means 38.

The machine shown in FIG. 1 is a vertical travel machine.

The present invention applies equally well to horizontal travel machines.

Furthermore, the present invention can also be applied to apparatuses for forming bags by using a film 12 that is prefitted on the reel 10 with transversely-extending tape having an opening/closing function.

Similarly, the invention applies to apparatuses for forming bags in which the tape having the opening/closing function is fitted to the film 12 at a location other than that shown in FIG. 1, for example at the forming neck 16 or downstream therefrom.

As mentioned above, the present invention applies to any type of tape having an opening/closing function for bags, in particular it applies to tapes comprising complementary closure strips such as male/female strips, strips having complementary hooks, tear/cut tapes, adhesive tapes, which can optionally be peel-off tapes, metal strips for closing by being folded, etc. . . .

The tape having the opening/closing function is given overall reference 60.

Similarly, the present invention applies to any type of film 12, for example plastics films, single layer or composite plastics films, metallized films, etc. . . .

As mentioned above, in the context of the present invention, at least one sensor is provided that is suitable for detecting the presence of the tape in an expected predetermined position relative to means for treating the film cyclically.

The sensor 100 is preferably constituted by a mechanical feeler comprising a pusher 102 that is urged towards the film 12, which film is sandwiched between the feeler or pusher 102 and an anvil-forming abutment 110. The pusher 102 is associated with an electrical contactor 104 that is responsive to the position of the pusher 102, i.e. is opened or closed depending on whether the opening/closing tape 60 is or is not present, and does or does not form an extra layer of thickness between the abutment 110 and the pusher 102.

Preferably, in the context of the present invention, the sensor 100 is placed downstream from the jaws 100 that perform transverse heat-sealing on the film.

Still more precisely, the sensor 100 and the anvil 110 are preferably carried by the equipment that supports the jaws 30 so that the anvil 110 and the sensor 100 are cyclically moved away from and moved towards to the film 12 synchronously with the heat-sealing jaws 30 so as to avoid disturbing the travel of the film 12.

Still more precisely, as shown diagrammatically in FIG. 4, the sensor 100 is preferably located level with the longitudinal edge of the bag that is remote from the edge via which the tape having an opening/closing function 60 is fed.

In FIG. 4, an arrow referenced A represents the feeding of the tape 60.

The person skilled in the art will understand that the sensor 100 of the present invention makes it possible to detect simultaneously:

- the presence of the tape 60 having an opening/closing function;
- proper feeding in the transverse direction of the tape 60, i.e. it can verify that the film is covered by the tape 60 (otherwise if the tape 60 does not cover the entire mouth of the bag, a subsequent closure defect can be expected, or even a subsequent leak); and
- that the tape 60 is properly positioned in the longitudinal direction relative to the travel direction of the film (wrong positioning in this direction would lead to the tape having an opening/closing function being wrongly positioned relative to the mouth of the bag).

Thus, in FIG. 2, there can be seen the case of the tape 60 when it is properly positioned relative to the heat-sealing jaws 30. In contrast, FIG. 3 shows a case when the tape 60 is detected as being in an incorrect position (in this case, the tape 60 is too far forward relative to the travel direction of the film).

When a problem is detected in this way and indicated by the sensor 100, it is possible to take action to reposition the film correctly. The present invention thus makes it possible to eliminate drift due in particular to the intrinsic elasticity of the film 12, or indeed to deformation thereof because of its quality, or indeed depending on the type of product being packaged or the way in which the product is poured into the bags via the funnel 18.

Where appropriate, as shown in FIGS. 5 to 8, it is possible in the context of the present invention to use a dual feeler 100*a*, 100*b* where the two feelers are juxtaposed in the film travel direction. As will be understood in particular on examining FIGS. 6 and 7, such a dual feeler makes it possible to improve the detection of positioning since it makes it possible to detect a simple offset from the expected position.

According to an advantageous additional characteristic of the invention, two sensors 100 can be provided respectively at the two opposite longitudinal edges of the film 12 so as to detect a fault in the positioning of the strip 60, whereby the strip slopes relative to a direction that extends accurately at right angles across the travel direction of the film.

Furthermore, as mentioned above, the present invention applies equally well to apparatuses in which the opening/closing strip is placed not transversely but longitudinally, i.e. parallel to the travel direction of the film, or indeed obliquely relative to said direction (in which case the positions of the sensors need to be adapted accordingly). In the oblique case, it is possible to provide at least two sensors respectively close to each of the edges of the bag on a generator line that slopes relative to the travel direction of the film and that corresponds to the expected oblique position of the tape.

Naturally, the present invention is not limited to the particular embodiments described above, but extends to any variant within the spirit of the invention.

What is claimed is:

1. A method of forming reclosable packaging bags using a continuously traveling film fitted with at least one closure tape (60), which extends transversely to a longitudinal travel direction of the film, wherein the method comprises;

cyclically sealing the film with a set of heat-sealing jaws (30) provided transversely relative to the travel direction of the film (12);

detecting a default in position of the tape (60) on the film by means of at least one sensor (100) provided in a predetermined position relative to said heat-sealing jaws;

and repositioning the film correctly in relation to the heat-sealing jaws when the sensor detects a default in the position of the tape, so as to eliminate drift due to the elasticity of the film, wherein the sensor comprises dual feelers that are juxtaposed in the longitudinal travel direction of the film, and wherein the repositioning is by repositioning means responsive to the detection of the default in the position of the tape by the at least sensor.

2. The method as claimed in claim 1, further comprising delivering the closure tape from an edge of the film, wherein the sensor (100) is formed by two mechanical feelers placed on the longitudinal edge of the film remote from the edge via which the tape (60) is delivered.

3. An apparatus for forming reclosable bags, wherein said bags are formed from a continuously traveling film (12) fitted with at least one closure tape (60), which extends transversely to a travel direction of the film, wherein the apparatus comprises;

a set of heat-sealing jaws (30) provided transversely relative to the travel direction of the film (12);

at least one sensor (100) provided in a predetermined position relative to said heat-sealing jaws, said sensor detecting a position of the tape or not on the film, wherein the sensor comprises dual feelers that are juxtaposed in the longitudinal travel direction of the film; and means to reposition the film correctly in relation to the heat-sealing jaws when the sensor detects a default in the position of the tape, so as to eliminate drift due to the elasticity of the film, wherein said repositioning means is responsive to detection of the default position by the sensor.

4. The apparatus as claimed in claim 3, wherein the sensor (100) is formed by two mechanical feelers, each having a pusher (102) associated with an electrical sensor (104).

5. The apparatus as claimed in claim 3, further comprising means (16) for shaping the film into a tubular bag blank and means (18) suitable for filling the tubular bag blank before applying said film to said heat-sealing jaws.

6. The apparatus as claimed in claim 3, further comprising means (14) for fixing the tape (60) onto the film (12).

7. The apparatus as claimed in claim 3, further comprising means for causing the film (12) to travel vertically.

8. The apparatus as claimed in claim 3, further comprising means for causing the film (12) to travel horizontally.

9. The apparatus as claimed in claim 3, wherein the closure tape (60) is one of a complementary closure strip, a tear/cut tape, an adhesive tape, and a metal tape for closing by folding.

10. The apparatus as claimed in claim 9, wherein the complimentary closure strips are male/female strips.

11. The apparatus as claimed in claim 9, wherein the complementary closure strips have complementary hooks.

12. The apparatus as claimed in claim 9, wherein the adhesive tapes are peel-off tapes.

13. The apparatus as claimed in claim 3, further comprising means for delivering the closure tape positioned adjacent to an edge of the film, the sensor (100) is located along a longitudinal edge of the film remote from the edge via which the tape (60) is delivered.

14. The apparatus as claimed in claim 3 wherein the sensor (100) is adapted to detect the presence of a tape (60), to detect that the tape (60) has been fed properly in the direction that is transverse to the travel direction of the film (12), and to detect that the tape is properly positioned in the longitudinal direction of the film (12).

15. The apparatus as claimed in claim 3, wherein two sensors (100) are disposed close to respective edges of the bag along a generator line that is oblique relative to the travel direction of the film (12).

16. An apparatus for forming reclosable bags, wherein said bags are formed from a continuously traveling film (12) fitted with at least one closure tape (60), which extends transversely to a longitudinal travel direction of the film, wherein the apparatus comprises:

a set of heat-sealing jaws (30) provided transversely relative to the travel direction of the film (12);

at least one sensor (100) provided in a predetermined position relative to said heat-sealing jaws, said sensor generating a first signal when it detects a thickness corresponding to the presence of the closure tape and generating a second signal corresponding to a default signal when it detects a thickness less than the thickness of the closure tape, wherein the sensor comprises dual feelers that are juxtaposed in the longitudinal travel direction of the film; and means for positioning the film correctly in relation to the heat-sealing jaws when the sensor detects a default in the position of the tape, so as to eliminate drift due to the elasticity of the film, wherein said repositioning means is responsive to said default signal.

* * * * *

UNITED STATES PATENT AND TRADEMARK OFFICE

CERTIFICATE OF CORRECTION

PATENT NO. : 6,886,310 B1
DATED : May 3, 2005
INVENTOR(S) : Henri-Georges Bois

It is certified that error appears in the above-identified patent and that said Letters Patent is hereby corrected as shown below:

Title page,
Item [54], Title, "DEVICE AND METHOD FOR MAKING PACKAGING BAGS" should read -- APPARATUS AND A METHOD OF MANUFACTURING PACKAGING BAGS --.

Signed and Sealed this

Ninth Day of August, 2005

JON W. DUDAS
*Director of the United States Patent and Trademark Office*